US007637084B2

(12) United States Patent
Aikenhead

(10) Patent No.: US 7,637,084 B2
(45) Date of Patent: Dec. 29, 2009

(54) TRIANGULAR PACKAGING

(75) Inventor: Charles Aikenhead, Hants. (GB)

(73) Assignee: Kenbico Limited (GB)

( * ) Notice: Subject to any disclaimer, the term of this patent is extended or adjusted under 35 U.S.C. 154(b) by 673 days.

(21) Appl. No.: 11/311,881

(22) Filed: Dec. 19, 2005

(65) Prior Publication Data

US 2006/0177159 A1 Aug. 10, 2006

(30) Foreign Application Priority Data

Dec. 17, 2004 (GB) ..... 0427805.7

(51) Int. Cl.

| | |
|---|---|
| ***B65B 11/58*** | (2006.01) |
| ***B65B 43/10*** | (2006.01) |
| *B31B 15/26* | (2006.01) |
| *B65D 33/02* | (2006.01) |

(52) U.S. Cl. ..... 53/449; 53/445; 53/456; 493/386; 493/480; 383/119

(58) Field of Classification Search ..... 53/449, 53/429, 455, 445, 456, 457, 562; 493/218, 493/219, 386, 480; 383/104, 907, 119
See application file for complete search history.

(56) References Cited

U.S. PATENT DOCUMENTS

| | | | | | |
|---|---|---|---|---|---|
| D14,896 | S | * | 3/1884 | Wilson | D3/272 |
| 1,253,269 | A | * | 1/1918 | Moeller | 383/37 |
| 2,893,876 | A | * | 7/1959 | Patrick | 426/87 |
| 3,016,673 | A | * | 1/1962 | Parker | 53/390 |
| 3,195,803 | A | * | 7/1965 | Ford | 229/87.08 |
| 3,299,612 | A | * | 1/1967 | Daniel | 53/210 |
| 3,516,228 | A | * | 6/1970 | Fellner | 53/390 |
| 3,562,999 | A | * | 2/1971 | Barbedienne | 53/441 |
| 3,627,116 | A | * | 12/1971 | Cooper | 206/497 |
| 3,796,307 | A | * | 3/1974 | McKinney | 206/497 |
| 3,937,645 | A | * | 2/1976 | Ascoli et al. | 156/522 |
| 4,230,728 | A | * | 10/1980 | Tezuka | 426/115 |
| 4,784,864 | A | * | 11/1988 | Ikeda | 426/115 |
| 4,795,648 | A | * | 1/1989 | Capy et al. | 426/111 |
| 5,496,252 | A | * | 3/1996 | Gilbert | 493/224 |

(Continued)

FOREIGN PATENT DOCUMENTS

| | | | |
|---|---|---|---|
| EP | 1 378 459 | * | 7/2004 |

*Primary Examiner*—Paul R Durand
(74) *Attorney, Agent, or Firm*—Lerner, David, Littenberg, Krumholz & Mentlik, LLP

(57) ABSTRACT

Triangular packaging comprising a flexible outer wrapper and an inner support means, in which the flexible outer wrapper comprises a bag formed from two panels, each of which has a first side, a second side extending from a first end of the first side at a first angle which is greater than 90 degrees to the first side, and a third side extending from a second end of the first side at substantially the same greater than 90 degrees first angle in the opposite direction, in which the first sides of the two panels meet, the second sides of the two panels meet and the third sides of the two panels meet such that a bag is formed, in which the inner support means is disposed inside said bag, and is mounted in compression between the two panels such that a complimentary packaging structure is formed in which the first sides of the two panels meet at a second angle which is substantially twice that by which the first angle exceeds 90 degrees.

3 Claims, 3 Drawing Sheets

U.S. PATENT DOCUMENTS

| | | | | |
|---|---|---|---|---|
| D369,540 | S * | 5/1996 | Weder et al. | D9/629 |
| 5,955,133 | A * | 9/1999 | Bowers et al. | 426/410 |
| 6,068,585 | A * | 5/2000 | Ouchi | 493/213 |
| 6,416,223 | B2 * | 7/2002 | de Laforcade | 53/456 |
| 6,544,569 | B1 * | 4/2003 | Suzuki et al. | 426/115 |
| 6,581,764 | B1 * | 6/2003 | Hillebrand | 206/225 |
| D476,883 | S * | 7/2003 | Krohne | D9/705 |
| 6,609,998 | B2 * | 8/2003 | Lauzon et al. | 493/194 |
| 7,331,451 | B2 * | 2/2008 | Focke et al. | 206/264 |
| D572,603 | S * | 7/2008 | Josephs | D9/709 |
| 7,428,807 | B2 * | 9/2008 | Vander Bush et al. | 53/425 |
| D583,256 | S * | 12/2008 | Rothstein | D9/709 |

* cited by examiner

TRIANGULAR PACKAGING

BACKGROUND OF THE INVENTION

This invention relates to triangular packaging for substantially triangular shaped objects, for use particularly, but not exclusively, to package sandwiches.

Sandwiches are a popular fast food widely sold from various outlets, and are commonly created from two square slices of bread laid on top of one another with a filling spread in between. Most pre-packed sandwiches are sliced into two triangular pieces and sold in a triangular package. The slices are placed next to one another, with the longest side facing uppermost in the package so the filling can be seen.

There are many known types of triangular packaging for carrying sandwich slices in this manner. Some are made from a clear plastics material moulded into a triangular wedge shape, and others are constructed from a card board template folded and glued together to form the same shape. Various types of sandwich packaging are specifically adapted to be wrapped around triangular sandwiches during construction of the product, while others are sold as empty containers to be filled with sandwiches on site.

When sandwiches are to be packaged on site, it is necessary to facilitate the effective storage and transportation of the packaging to that site. When a sandwich pack is pre-formed into the wedge shape it cannot be readily stored or transported because of its size and shape. It is sometimes possible to stack such packs one on top of the other but such stacks still take up a great deal of space.

Therefore, it is known to provide such triangular wedge shaped packs made from cardboard which can be folded flat for storage and transportation.

There are several known ways to close a triangular sandwich pack, including with a door portion which folds over the opening. However, when a collapsible cardboard pack is used, such a door cannot provide an effective seal to protect the contents from spoiling. One common way to provide such a seal is to wrap the pack with a cellophane plastics material. In some case this can be done with the aid of various machines. However, this method can be time consuming, and does not result in an attractive, or particularly robust end result.

BRIEF SUMMARY OF THE INVENTION

The present invention is intended to overcome some of the above problems.

Therefore, according to the present invention triangular packaging comprises a flexible outer wrapper and an inner support means, in which the flexible outer wrapper comprises a bag formed from two panels, each of which has a first side, a second side extending from a first end of the first side at a first angle which is greater than 90 degrees to the first side, and a third side extending from a second end of the first side at substantially the same greater than 90 degrees first angle in the opposite direction, in which the first sides of the two panels meet, the second sides of the two panels meet and the third sides of the two panels meet such that a bag is formed, in which the inner support means is disposed inside said bag, and is mounted in compression between the two panels such that a complimentary packaging structure is formed in which the first sides of the two panels meet at a second angle which is substantially twice that by which the first angle exceeds 90 degrees.

It will be appreciated that the invention can be used with any item or items which can fit inside the packaging. However, the invention is preferably used to package triangular wedge-shaped sandwiches.

Therefore, in a preferred construction the inner support means can comprise two support members, first ends of which meet at an angled edge. The inner support means can be disposed inside the bag with a second end of a first support member against a base of the bag where the first sides of the two panels meet, and a second support member mounted between the two panels such that the second angle is maintained. The second angle can be substantially 45 degrees.

The support members can be rectangular panels, and the first ends of the support members can meet at substantially 90 degrees. Thus, the inner support member can be an L-shaped component which can support two triangular sandwiches.

Preferably the two panels may be rhombus shaped, such that the bag is formed with an opening parallel to the base.

Portions of the bag can extend beyond all four edges of the second support member. Said portions of the bag can be folded onto the second support member, and secured by fixture means. Preferably the fixture means can be an adhesive backed paper-based label, however in an alternative embodiment the fixture means can comprise the application of heat to the bag to mould said portions together.

The bag can be formed from a transparent plastics material template in the shape of two rhombuses meeting along the shorter of their two parallel sides. The template can be folded in half about an axis in line with said shorter sides, and the angled sides of said two rhombuses can then be moulded together to form the bag.

In an alternative construction the bag can be formed from two separate rhombus shaped pieces of transparent plastics material, and the shorter of the two pieces' parallel sides can be moulded together, as well as the angled sides of the two pieces.

The inner support means can comprise a very simple open-face triangular wedge-shaped sandwich pack. Thus, in a preferred construction the inner support means can further comprise substantially right-angle isosceles triangle shaped sides perpendicular to the support members.

The inner support means can be collapsible prior to use. In addition extension elements can extend into the open rectangular side from second ends of the support members, and the extension elements can be biased away from the opening. Therefore, when the inner support means is contained in the bag, the extension elements can hold the portion of the bag disposed over the opening away from the sandwiches inside.

Preferably the inner support means can be formed form a single piece of card board material, and the extension elements can be biased away from the opening by being folded in relation to the support members to an angle less than 135 degrees.

The invention also includes a method of using the above described invention to package an item or items, and in particular a method of doing so so the bag is closed in an attractive manner.

Therefore, the invention also includes a method of packaging an item or items with the triangular packaging as described above, includes the following steps:

1. Placing the inner support means around the item or items to be packaged.
2. Placing the inner support means inside the bag with the second end of the first support member against the base of the bag,
3. Mounting the second support member between the two panels such that the second angle is maintained.

4. Applying a force to urge the second end of the first support member against the base of the bag,
5. Folding a portion of the bag which extends from the angled edge of the support means, until said portion is flush with the second support member,
6. Folding portions of the bag extending from sides of the second support member perpendicular to said angled edge, until said portions are flush with the second support member,
7. Folding a portion of the bag which extends from the end of the second of said two sides of the contents, until said portion is flush with the support member,
8. Securing said portions of the bag by fixture means.

In addition, the invention also includes methods of manufacturing the bag. A first relates to the manufacture of the bag when it is formed from a transparent plastics material template in the shape of two rhombuses meeting along the shorter of their two parallel sides.

Therefore, a method of manufacturing a bag for use with triangular packaging as described above, includes the following steps:

1. Cutting the template from a roll of folded transparent plastics material, such that the template is already folded in half when it is cut,
2. Moulding together the angled sides of said two rhombuses.

A second method of manufacturing the bag relates to the manufacture when the bag is formed from two separate rhombus shaped pieces of transparent plastics material.

Therefore, a method of manufacturing a bag for use with triangular packaging as described above, includes the following steps:

1. Cutting the two separate rhombus shaped pieces of transparent plastics material from a double layer of transparent plastics material, such that the two separate rhombus shaped pieces of transparent plastics material are positioned on top of one another, ready for step 2
2. Moulding together the shorter of the two pieces' parallel sides, and the opposing angled sides of the two pieces.

BRIEF DESCRIPTION OF THE DRAWINGS

The invention can be performed in various ways, but one embodiment will now be described by way of example and with reference to the accompanying drawings, in which.

DETAILED DESCRIPTION

Figure 1:
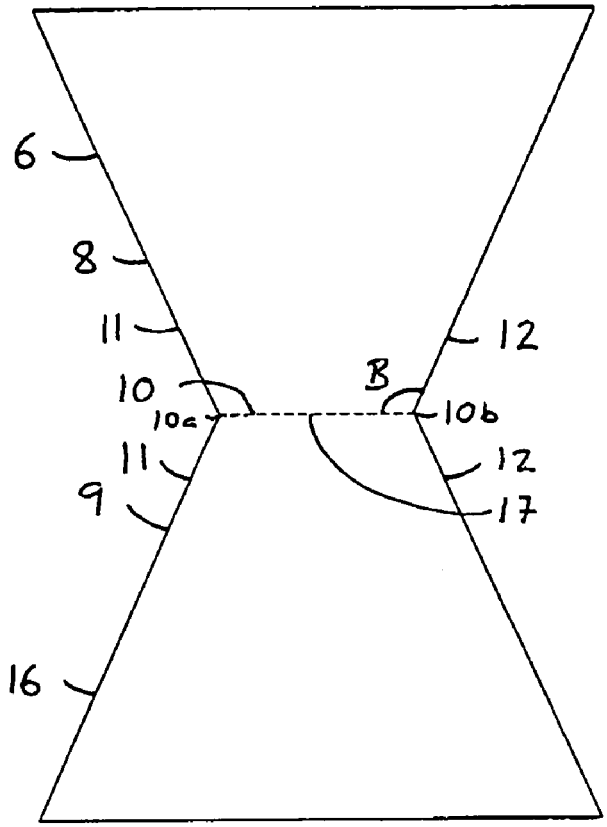
FIG. 1 is a top view of a template for a bag for use in the present invention.
Figure 5:
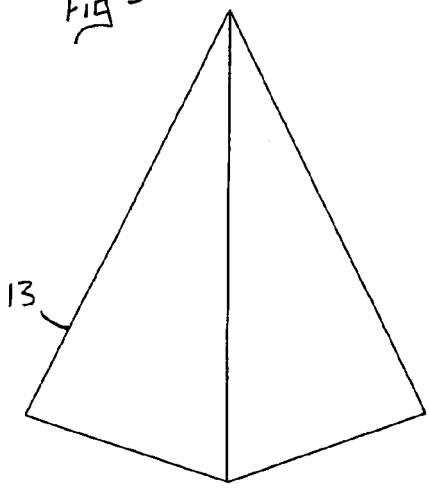
FIG. 5 is a side view of the bag shown in FIG. 2 opened up into a three dimensional shape.
Figure 6:
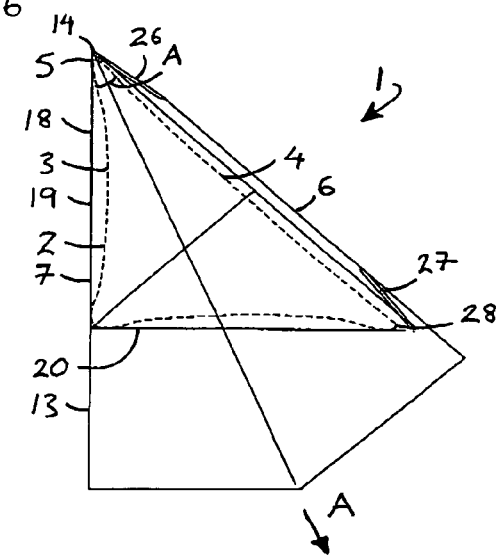
FIG. 6 is a side view of the packaging according to the present invention in a non-closed arrangement; and, FIGS. 7*a* to 7*e* show bottom views of the packaging shown in FIG. 6 in the various steps involved in closing the packaging.

As shown in FIG. 6 triangular packaging 1 comprises a flexible outer wrapper 6 and inner support means 7. As shown in FIGS. 5 and 1, the flexible wrapper 6 comprises a bag 13, formed from two flat panels 8 and 9, each of which has a first side 10, a second side 11 extending from a first end 10*a* of the first side 10 at a first angle which is greater than 90 degrees to the first side 10, and a third side 12 extending from a second end 10*b* of the first side 10 at substantially the same greater than 90 degrees first angle in the opposite direction, which is shown in FIG. 1 as angle B.

Figure 2:
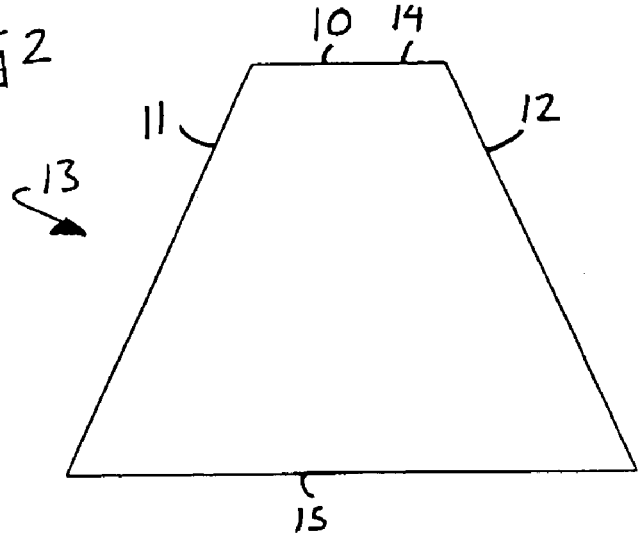
FIG. 2 is a side view of a bag for use in the present invention lying flat.

FIG. 1 shows the outer wrapper as a template prior to being formed as a bag, and as is clear from FIG. 1, the first sides 10 of the two panels 8 and 9 meet. FIG. 2 shows the outer wrapper formed as a bag, and as is clear from FIG. 2, the second sides 11 of the two panels 8 and 9 meet and the third sides 12 of the two panels 8 and 9 also meet such that a bag 13 is formed. As is shown in FIG. 6, and as is further explained below, the inner support means 7 is disposed inside said bag 13 and is mounted in compression between the two panels 8 and 9 such that a complimentary packaging structure is formed, with the first sides 10 of the two panels 8 and 9 meeting at a second angle which is substantially twice that by which the first angle (B) exceeds 90 degrees.

The packaging 1 is used to package two triangular sandwich slices, the outline of one of which 2, is shown in FIG. 6. Two sandwich slices arranged next to one another in the known manner form a shape in which the angle A is substantially 45 degrees. The angle is "substantially" 45 degrees because sandwich slices are flexible, and do not generally end in a regular straight edge due to the irregular curvature of the crust around a slice of bread. The "sides" 3 and 4 of the two sandwich slices arranged next to one another comprise the sides of the slices of bread, and whatever filling is placed between them. Generally speaking these sides are rectangular in shape. The cross-section perpendicular to these sides, which is defined by the outline shown in FIG. 6, is generally a right-angle isosceles triangle shape.

As shown in FIGS. 1 and 2 the two panels 8 and 9 of the flexible wrapper are rhombus shaped, such that when they are joined together the bag 13 is formed with a straight opening 15 parallel to a base 14. The bag 13 is formed from a double rhombus shaped transparent plastics material template 16, in which the rhombuses (the two halves 8 and 9) meet along the first sides 10. Clearly, in this embodiment there are no first "sides" as such, rather the two halves meet along an axis 17 shown by a hashed line. The template 16 is folded in half about the axis 17, and the two pairs of opposing angled sides 11 and 12 are moulded together in a known way to form the bag 13.

The template was constructed by cutting it from a roll of folded transparent plastics material, such that the template was already folded in half when it was cut, ready for the moulding stage. FIG. 1 shows the template in an unfolded position for illustrative purposes only. During constructions it would not be arranged thus.

Figure 3:
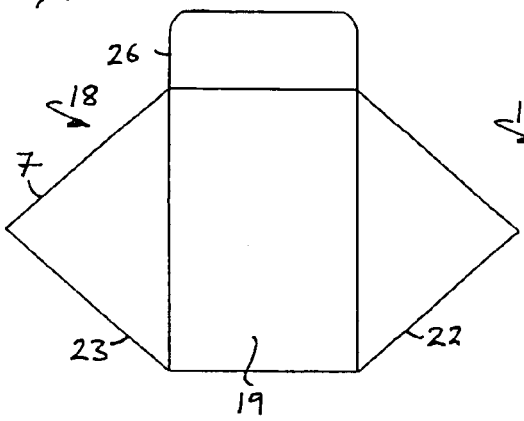
FIG. 3 is a top view of support means for use in the present invention in a first arrangement.
Figure 4:
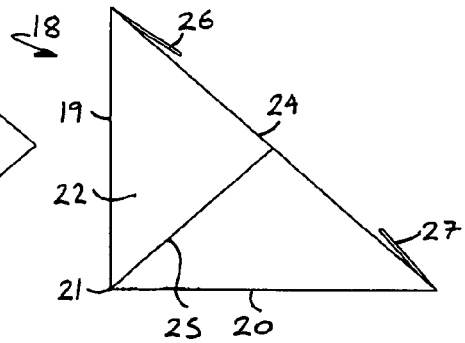
FIG. 4 is a side view of the support means shown in FIG. 3 in a second arrangement.

The inner support means 7 is collapsible triangular wedge-shaped sandwich pack 18, which is shown in a folded flat arrangement in FIG. 3, and an erect arrangement in FIG. 4. The pack 18 comprises two rectangular sides 19 and 20, which are the "support members" according to the invention. When the pack is erect in use as shown in FIG. 4, the sides 19 and 20 meet at right angled edge 21.

The pack 18 also comprises right-angle isosceles triangle shaped sides 22 and 23 which are perpendicular to the sides 19 and 20. Therefore, when erect the pack 18 is a wedge-shaped container with one open rectangular side 24.

The right-angle isosceles triangle shaped sides 22 and 23 fold in half along fold line 25, and the sides 19 and 20 can be folded together about the edge 21, which allows the pack 18 to be folded flat as shown in FIG. 3. Extension elements 26 and 27 are provided at the ends of the sides 19 and 20.

The pack 18 is constructed from a card board template. The sides 22 and 23 are provided with tabs (not visible) which are glued to the upper side of side 20, so the working pack 18 is provided.

In the folded flat arrangement shown in FIG. 3 the extension elements 26 and 27 are arranged co-planar with the sides 19 and 20. In the erect arrangement shown in FIG. 4 the extension elements 26 and 27 are folded in relation to the sides 19 and 20 to an angle less than 135 degrees. As a result they are biased away from the open side 24, as is clear from FIG. 4.

As is shown in FIG. 6, the inner support means 7 is disposed inside the bag 13 with a second end 5 of the first support member 19 against the base 14. Further the second support member 20 mounted between the two panels 8 and 9 such that the second angle is maintained. As will be explained below, it is this arrangement which facilitates the most advantageous arrangement of the invention.

Therefore, in use the sandwich slices 2 are placed inside the pack 18. The bag 13 is then opened as shown in FIG. 5, and placed over the pack 18, as shown in FIG. 6. In doing so, the bag 18 is pulled in the direction of arrow A. (It will be appreciated that the contents 2 and 18 could also be placed in the bag 13 with the components the opposite way up to the positions shown.)

When the bag 18 is pulled in the direction of arrow A the side 19 of the pack 18 prevent the sandwich collapsing in the direction of arrow A. Further, the side 20 of the pack 18 prevents the sandwich from collapsing towards the side 19 when the bag 13 is pulled in the direction of arrow A. This is because it is mounted between the panels 8 and 9, in other words, the pack 18 maintains the first angle when the bag 13 is pulled in the direction of arrow A.

As is also clear from FIG. 6, the extension elements 26 and 27 urge the bag 13 away from the opening in use, thereby preventing the bag from being soiled by the sandwiches 2.

(It will be appreciated that the inner support means could comprise only the sides 19 and 20 of the pack 13, as these parts provide the essential features of the inner support means of the invention. If that were the case then the edge 5 of the sandwich would contact the base 14 of the bag 13, and the front 4 of the sandwich would also contact the bag 13. Such an arrangement is described below as an alternative embodiment.)

The bag 13 is larger than the pack 18, and as a result portions of the bag 13 extend beyond the side 20 of the pack 18, as is shown in FIG. 6. Said portions of the bag 13 are folded onto the side 20, and held down with adhesive backed paper label 29, as explained below.

The invention also includes a method of packaging an item or items with the triangular packaging as described above. Steps 1 to 4 of the method are as described above, and steps 5 to 8 are shown in FIGS. 7*a* to 7*e*.

FIGS. 7*a* to 7*e* show the pack 18 from the underside, with side 20 in view and edge 21 at the bottom.

Figure 7A:
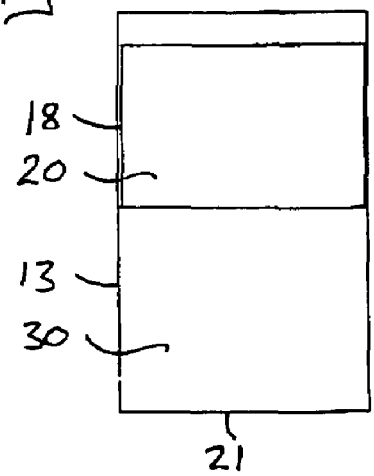

Firstly portion 30 of the bag 13 which extends from the edge 21 is folded through 90 degrees until it is flush with the side 20, as is shown in FIG. 7*a*.

Figure 7B:
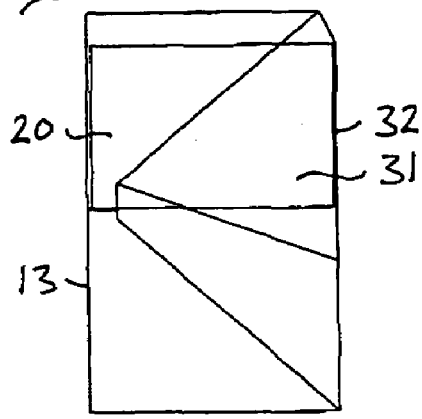
Figure 7C:
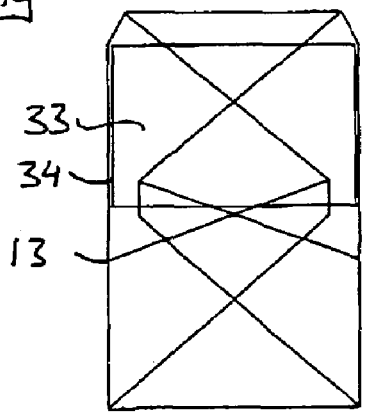

Then, portion 31 of the bag 13 which extends from edge 32 of the side 20 is folded through 90 degrees until it is flush with the side 20, as is shown in FIG. 7*b*. The same is then done with portion 33 which extends from edge 34 of the side 20, as is shown in FIG. 7*c*.

Figure 7D:
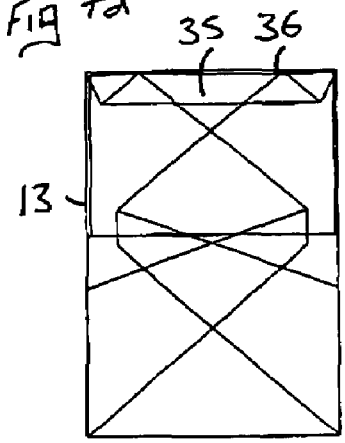

The last portion 35 of the bag 13 which extends from the edge 36 of the side 20, is then folded through 90 degrees until it is flush with the side 20 as is shown in FIG. 7*d*. Finally the label 29 is applied over the folded portions to hold them in position.

The last two steps can be performed simultaneously in other words, the label 29 can be applied to the portion 35 of the bag 13, and then the portion 35 and the label 29 can be folded round onto the rest of the portions.

Figure 7E:
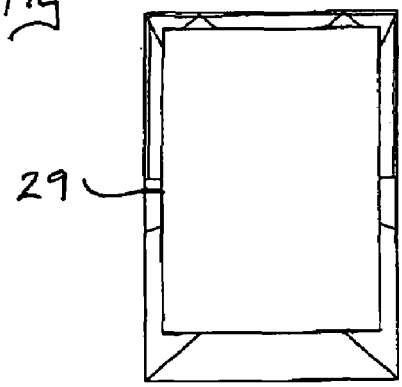

As is clear from FIGS. 6 to 7*e*, the portions 31 and 33 are shorter in length than the side 20, and thus do not extend beyond it when they are folded onto it.

The above described steps are performed in such a way that the bag 13 is held in extension over the pack 18. In other words when the portions of the bag 13 are folded onto the side 20 they are pulled taut into position. As a result the bag 13 is held tightly over the pack 18, which creates resilient and robust packaging. This can only be done because of the particular shapes of the components involved.

As a result of the second angle being twice that by which the first angle B exceeds 90 degrees, and base 14 being the same length as the second end 5 of the first support member 19, the pack 18 and the contents 2 fit perfectly inside the bag 13, as shown in FIG. 6. As a result the bag 13 can be pulled in the direction of arrow A, and there is no slack around the pack 18 and the contents 2.

When portion 30 of the bag 13 is folded around edge 21, it can be pulled taut because the base 14 cannot slide around the end 5 of the pack 18 (which in practice is the end of side 19), and because the side 19 is rigid. When the portions 31 and 33 of the bag 13 are folded onto side 20, they can be pulled taut because the end 5 (end of side 19) cannot rotate away from the base 14. Portion 35 can be pulled taut, again because the base 14 cannot slide out of position, and because side 20 is rigid.

Therefore, neat, tidy and tight packaging is provided for sandwiches, as a result of the shape of the bag 13, and the presence of the sides 19 and 20 being arranged as they are around the sandwich 2. Further, such packaging is provided with can be arranged flat, for transport and storage, and which can be unfurled for use and applied to sandwiches very quickly and easily. In addition, this packaging provides an adequate seal for the contents.

The embodiment described can be altered without departing from the spirit of the invention. For example, in one alternative embodiment (not shown) the inner support means can comprise simply sides 19 and 20. As described above the invention will still function with such an arrangement, and it would be cheaper and easier to make.

In another alternative embodiment (not shown) the extension elements 26 and 27 are not provided. It will be appreciated that in the embodiment shown, when the portion 35 is pulled taut around edge 36, this can have the effect of forcing the extension elements into positions substantially co-planar with the opening 24. As a result they may not effectively function to hold the bag 13 away from the contents as intended. However, they can still provide a protective function, and allow printed matter to be displayed. In addition, they add rigidity to the end 5 (end of side 19) and the end of sides 20, and prevent them folding up when the bag 13 is pulled taut around the contents.

In a further embodiment (show shown) the portions 30, 31, 33 and 35 are not fixed in position by means of a label 29, rather heat is applied and the portions are heat moulded together. This can be done by placing the folded packaging shown in FIG. 7*d* onto a hot plate, or similar.

In one other alternative embodiment the bag 13 is formed from two separate rhombus shaped pieces of transparent plastics material, and the shorter of the two pieces' parallel sides are moulded together, and the angled sides of the two pieces are moulded together. The two pieces are cut from a double layer of transparent plastics material, such that they are ready positioned on top of one another for the moulding stage.

The invention claimed is:

1. A method of packaging an item or items with triangular packaging comprising a flexible outer wrapper and an inner support means, in which the flexible outer wrapper comprises a bag formed from two rhombus shaped panels, each of which has a first side, a second side extending from a first end of the first side at a first angle which is greater than 90 degrees to the first side, and a third side extending from a second end of the first side at substantially the same greater than 90 degrees first angle in the opposite direction, in which the first sides of the two panels meet, the second sides of the two panels meet and the third sides of the two panels meet such that a bag is formed with a base where the two panels means and an opening parallel to said base, in which the inner support means comprises two rectangular support members, first ends of which meet at a substantially 90 degrees edge, in which the inner support means is disposed inside the bag with a second end of a first support member against said base of the bag, and a second support member mounted in compression between the two panels such that a complimentary packaging structure is formed in which the first sides of the two panels meet at substantially 45 degrees, and in which portions of the bag extend beyond all four edges of the second support member including the following steps:

placing the inner support means around the item or items to be packaged, placing the inner support means inside the bag with the second end of the first support member against the base of the bag, mounting the second support member between the two panels such that the first sides of the two panels meet at substantially 45 degrees, applying a force to urge the second end of the first support member against the base of the bag, folding a portion of the bag which extends from the substantially 90 degree edge of the support means, until said portion is flush with the second support member, folding portions of the bag extending from sides of the second support member perpendicular to said substantially 90 degree edge, until said portions are flush with the second support member, folding a portion of the bag which extends from a second end of the second support member, until said portion is flush with the support member, and securing said portions of the bag by fixture means.

2. The method of packaging an item or items as claimed in claim 1, in which the fixture means is an adhesive backed paper-based label.

3. The method of packaging an item or items as claimed in claim 1, in which the fixture means comprises the application of heat to the bag to mold said portions together.

* * * * *

UNITED STATES PATENT AND TRADEMARK OFFICE

CERTIFICATE OF CORRECTION

PATENT NO. : 7,637,084 B2
APPLICATION NO. : 11/311881
DATED : December 29, 2009
INVENTOR(S) : Charles Aikenhead It is certified that error appears in the above-identified patent and that said Letters Patent is hereby corrected as shown below:

Column 7, line 18, “panels means” should read --panels meet--.

Signed and Sealed this
First Day of March, 2011

David J. Kappos

David J. Kappos
*Director of the United States Patent and Trademark Office*